US005421708A

United States Patent [19]

Utter et al.

[11] Patent Number: 5,421,708

[45] Date of Patent: Jun. 6, 1995

[54] OIL SEPARATION AND BEARING LUBRICATION IN A HIGH SIDE CO-ROTATING SCROLL COMPRESSOR

[75] Inventors: Robert E. Utter, Whitehouse; S. Boyd Wall, Tyler; Charles A. Singletary, Whitehouse, all of Tex.; Gene M. Fields, Bristol, Tenn.; Joe T. Hill, Bristol, Va.; John R. Williams, Bristol, Tenn.

[73] Assignee: Alliance Compressors Inc., Tyler, Tex.

[21] Appl. No.: 197,084

[22] Filed: Feb. 16, 1994

[51] Int. Cl.[6] ..... F01C 1/04

[52] U.S. Cl. ..... 418/55.6; 418/2; 418/94; 418/DIG. 1

[58] Field of Search ..... 418/2, 55.6, 94, 97, 418/99, 188, DIG. 1; 184/6.18

[56] References Cited

U.S. PATENT DOCUMENTS

| | | | |
|---|---|---|---|
| 3,176,914 | 4/1965 | Rinehart | 230/207 |
| 4,061,935 | 12/1977 | Kandpal | 310/68 |
| 4,549,861 | 10/1985 | Blain | 418/55 |
| 4,552,518 | 11/1985 | Utter | 418/55 |
| 4,568,256 | 2/1986 | Blain | 418/55 |
| 4,734,602 | 3/1988 | Hauser et al. | 310/68 |
| 4,889,471 | 12/1989 | Izunaga et al. | 418/94 |
| 4,926,081 | 5/1990 | DiFlora et al. | 310/89 |
| 4,927,339 | 5/1990 | Riffe et al. | 418/55 |
| 4,958,991 | 9/1990 | Kikuchi | 418/55 |
| 4,995,789 | 2/1991 | Fujio | 417/360 |
| 5,040,952 | 8/1991 | Inoue et al. | 417/312 |
| 5,080,566 | 1/1992 | Sakata et al. | 418/55 |
| 5,087,170 | 2/1992 | Kousokabe et al. | 415/110 |
| 5,099,658 | 3/1992 | Utter et al. | 62/498 |
| 5,118,260 | 6/1992 | Fraser, Jr. | 417/18 |
| 5,129,798 | 7/1992 | Crum et al. | 418/55 |
| 5,142,885 | 9/1992 | Utter et al. | 62/498 |

FOREIGN PATENT DOCUMENTS

| | | | |
|---|---|---|---|
| 0227583 | 9/1990 | Japan | 418/55.6 |
| 0227584 | 9/1990 | Japan | 418/55.6 |
| 5001690 | 1/1993 | Japan | 418/55.6 |

*Primary Examiner*—Richard A. Bertsch
*Assistant Examiner*—Charles G. Freay
*Attorney, Agent, or Firm*—William J. Beres; William O'Driscoll; Peter D. Ferguson

[57] ABSTRACT

A high side co-rotating refrigerant scroll compressor includes a motor disposed vertically above its compression mechanism. The discharge of gas from the compression mechanism is through the drive shaft of the drive scroll member which is rotatably supported at its distal end in an upper bearing. Upper bearing lubrication is accomplished by the disentrainment of oil from the mixture of compressed refrigerant gas and oil discharged from the compression mechanism in the vicinity of the bearing and by the direction of such disentrained oil to the bearing.

39 Claims, 4 Drawing Sheets

FIG. 2
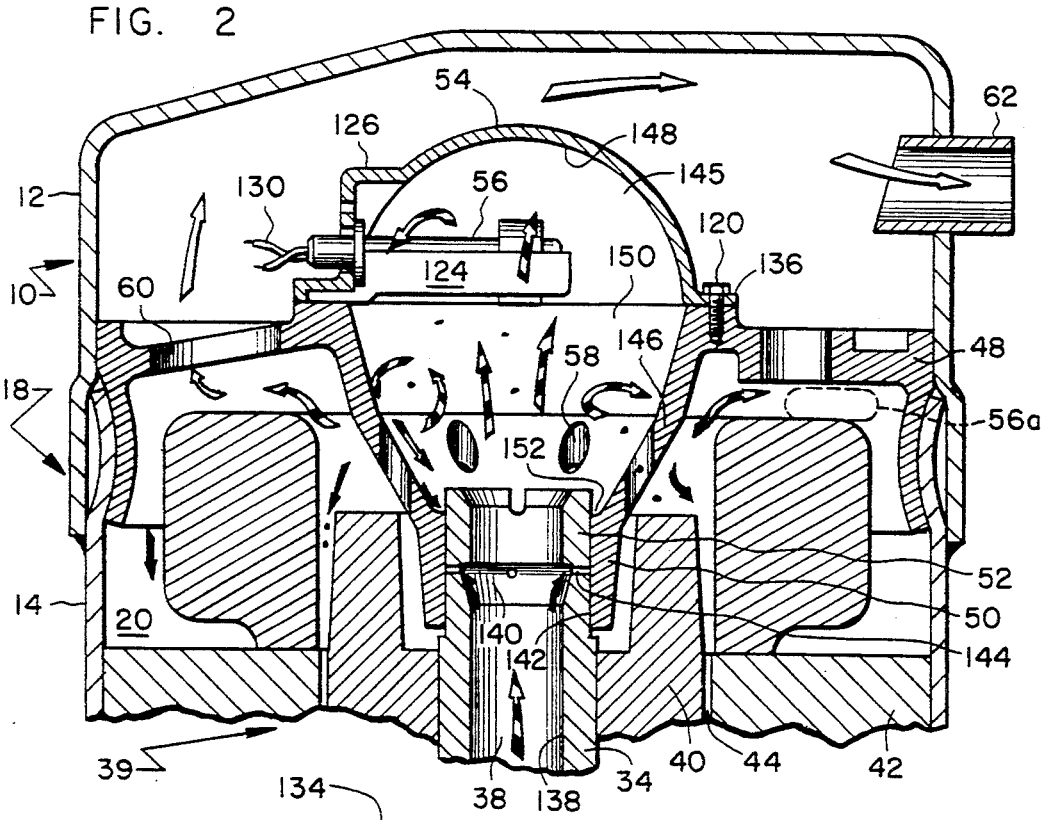
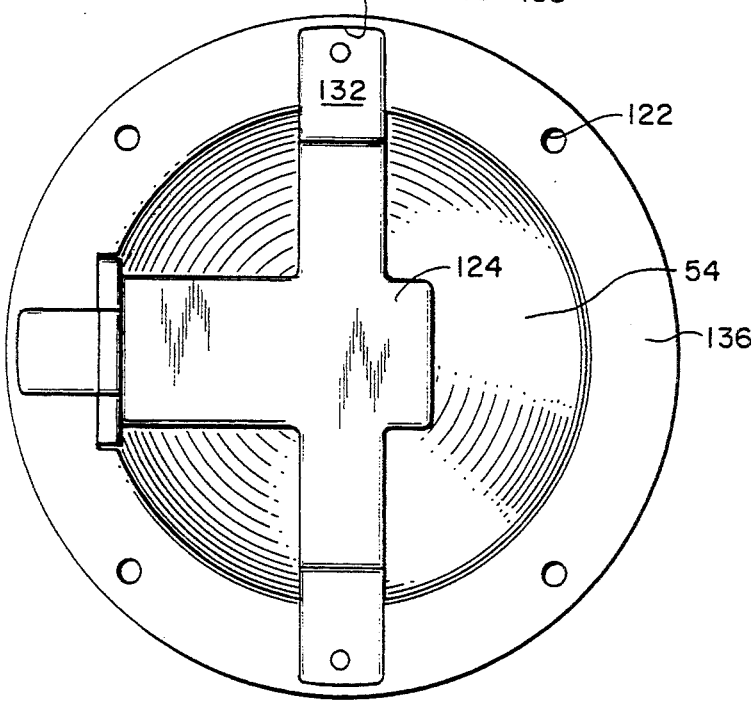
FIG. 3

OIL SEPARATION AND BEARING LUBRICATION IN A HIGH SIDE CO-ROTATING SCROLL COMPRESSOR

BACKGROUND OF THE INVENTION

This invention pertains generally to scroll apparatus and more specifically to scroll compressors of the co-rotating type wherein both scroll members rotate on parallel, offset axes. With still more particularly, this invention relates to high-side co-rotating refrigerant scroll compressors wherein compressed refrigerant gas and the oil entrained therein is discharged through the drive shaft of the drive scroll member and wherein the distal end of the scroll member drive shaft is rotatably supported in a bearing proximate the location at which discharge gas and entrained oil exits the drive shaft.

Scroll compression apparatus is typically comprised of two scroll members each of which has an involute wrap. The wraps of the scroll members extend from an end plate and are in an interleaved relationship. Relative orbital motion of one scroll member with respect to the other causes the creation of a series of pockets between the scroll wraps which, in operation, decrease in volume thereby compressing any gas trapped therein.

Scroll compressors are typically of the type in which one of the scroll members is fixed while the other orbits thereabout or the co-rotating type in which both scroll members rotate on parallel but offset axes. In a co-rotating scroll compressor one of the scroll members is characterized as the drive scroll and the other as the idler scroll.

The drive scroll member is driven through a drive shaft which is integral to and extends from the end plate of the drive scroll member or by the mechanical linkage of a drive shaft to the drive scroll member. The scroll member drive shaft, whether integral to the drive scroll member or mechanically linked thereto, penetrates and is fixedly coupled for rotation with the rotor of the electric motor which drives the compressor.

Hermetic compressors (compressors in which both the drive motor and compression mechanism are disposed in a hermetic shell), including those of the scroll type, are categorized as being of the high side or low side type. A high side compressor is one in which the drive motor is disposed in a portion of the compressor shell which is at compressor discharge pressure when the compressor is in operation while a low side compressor is one in which the drive motor is disposed in the portion of the compressor shell which is at suction pressure in operation.

It has been prospectively determined, with respect to hermetic co-rotating scroll compressors, to be advantageous to employ a high side design in which the compressor drive motor is disposed physically above the compression mechanism and to use the drive shaft of the drive scroll member to communicate compressed refrigerant gas out of the compression mechanism. Exemplary in that regard are U.S. Pat. Nos. 4,927,339 and 5,080,566, the former being assigned to the assignee of the present invention and incorporated herein by reference.

It has been found by the inventors of the present invention that due to the tipping moments to which the scroll members of a co-rotating scroll compressor are exposed in operation, the use of two bearings to rotatably support the drive scroll member drive shaft, rather than the single bearing arrangements taught by the patents mentioned above, is advantageous. The unique nature and effect of the tipping forces to which co-rotating scroll members are exposed and various methods and apparatus by which the effects of such tipping can be accommodated and/or reduced are discussed in U.S. Pat. Nos. 5,099,658; 5,129,798 and 5,142,885, all assigned to the assignee of the present invention and all of which are incorporated herein by reference.

With respect to the use of a bearing at the upper end of the drive shaft of the drive scroll member in a high side co-rotating scroll compressor, where the compressor motor is disposed vertically above the compressor mechanism and where the drive shaft is used to convey compressed refrigerant gas therefrom, certain difficulties are presented in the lubrication of that bearing. In particular, the need exists to communicate lubricant quickly to that bearing at compressor startup and to provide lubricant to that bearing continuously during compressor operation. Although no such bearing arrangement in a co-rotating scroll compressor is known (no co-rotating scroll compressor is known to be in commercial production anywhere in the world as of the filing date hereof), much less one in which the drive scroll member is used to conduct compressed gas from the compression mechanism, similar arrangements in compressors other than of the scroll type are known such as the one described in U.S. Pat. No. 5,087,170 to Kousokabe.

The Kousokabe patent teaches a non-scroll compressor having a solid drive shaft and an arrangement in which discharge gas is routed upward through the rotor-stator gap of the motor into the vicinity of an upper bearing. Lubricant disentrained from such gas drains to the vicinity of the upper bearing to assist a primary source of lubricant in the lubrication of that bearing.

The upper bearing in Kousokabe is primarily lubricated by a pump which delivers oil upwardly to the bearing from an oil sump disposed below the drive motor when the compressor is driven at sufficiently high speeds. At lower speeds, when the pumping action is insufficient to provide for the full lubrication needs of that bearing using oil from the sump, the disentrained oil draining to the vicinity of the upper bearing is used to assist in its lubrication.

A similar oil separation/lubrication arrangement is suggested in an earlier U.S. Pat. No. , 4,995,789, to Fujio. Like the Kousokabe arrangement, a solid drive shaft is rotatably supported in an upper bearing in a hermetic compressor. Compressor discharge gas is delivered through a conduit which is routed external of the compressor shell to the vicinity of the upper bearing. Entrained lubricant is there separated and drained to the vicinity of the upper bearing for lubrication thereof.

Unlike like the Kousokabe arrangement, the Fujio compressor is a scroll compressor but one in which one of the scroll members is fixed and which employs only two bearings. Further, the scroll member drive shaft in Fujio, which is solid as mentioned above, drives the orbiting scroll member through a linkage. Additionally, compressor discharge gas is routed downwardly through the fixed scroll member, then outside of the compressor shell prior to final discharge therefrom.

There continues to be a need for a viable arrangement, in a high side co-rotating scroll compressor in which compressed gas is discharged through the drive scroll member drive shaft, by which to lubricate the bearing which rotatably supports the distal end of the drive shaft.

SUMMARY OF THE INVENTION

It is an object of the present invention to provide for the lubrication of the upper bearing in which the drive shaft of the drive scroll member is rotatably accommodated in a high side co-rotating scroll compressor where the drive scroll member drive shaft acts as the conduit by which compressed refrigerant gas is discharged from the compression mechanism.

It is a further object of the present invention to provide apparatus by which lubricant which is entrained in the compressed gas discharged from the compression mechanism in a co-rotating high side scroll compressor is disentrained in the vicinity of an upper bearing within the compressor, is directed to the upper bearing for lubrication thereof and is thence directed to a sump for re-use in the lubrication of other bearing surfaces within the compressor.

It is a further object of the present invention to provide for the lubrication of the upper bearing in a high side co-rotating scroll compressor, where a mixture of compressed gas and entrained lubricant exits the drive scroll member drive shaft in the vicinity of the upper bearing, without the necessity for or use of means for pumping lubricant from a sump within the compressor to the upper bearing location.

These and other objects of the present invention will become apparent when the attached drawing figures and following Description of the Preferred Embodiment are given full consideration.

In the present invention, the discharge of gas from the compression mechanism in a high side co-rotating scroll compressor together with the rotation of the drive scroll member drive shaft serves to carry lubricant entrained in the gas upward and radially outward through the drive scroll member drive shaft. A portion of the lubricant is disentrained and made available within the confines of the drive shaft along its inner side wall as a result of the centrifugal forces acting on the mixture.

The compressed gas and any remaining lubricant entrained therein impinges on an oil separator dome disposed above the distal upper end of the drive shaft which causes the further disentrainment of lubricant from the gas. The lubricant disentrained by impingement flows downwardly along the inner dome surface to a position radially outward of the drive scroll member drive shaft and is then funnelled downward to the vicinity of the bearing in which the distal end of the drive shaft is rotatably supported. After lubricating the upper bearing such oil drains to an oil sump in the lower portion of the discharge pressure portion of the compressor shell.

The compressed refrigerant gas from which the oil has been disentrained is directed out of the area of the separator dome and is discharged from the compressor having been "dried out" with respect to entrained lubricant. As a result, a three fold need is satisfied, the first need being to disentrain lubricant from the compressed refrigerant gas so that the gas can be efficiently used in a refrigeration system, the second need being to disentrain the lubricant from the compressed refrigerant gas to provide for the lubrication of the upper bearing in the compressor and the third need being to provide for the disentrainment of the lubricant from the compressed refrigerant gas so that it can be returned to a sump from which it is drawn in order to lubricate other surfaces in the compressor.

DESCRIPTION OF THE DRAWING FIGURES

FIG. 2 is an enlarged view of the upper portion of the compressor illustrated in FIG. 1.

FIG. 3 is a view of the oil separator dome of FIG. 1 taken along lines 3—3 of FIG. 1.

DESCRIPTION OF THE PREFERRED EMBODIMENT

Figure 1:
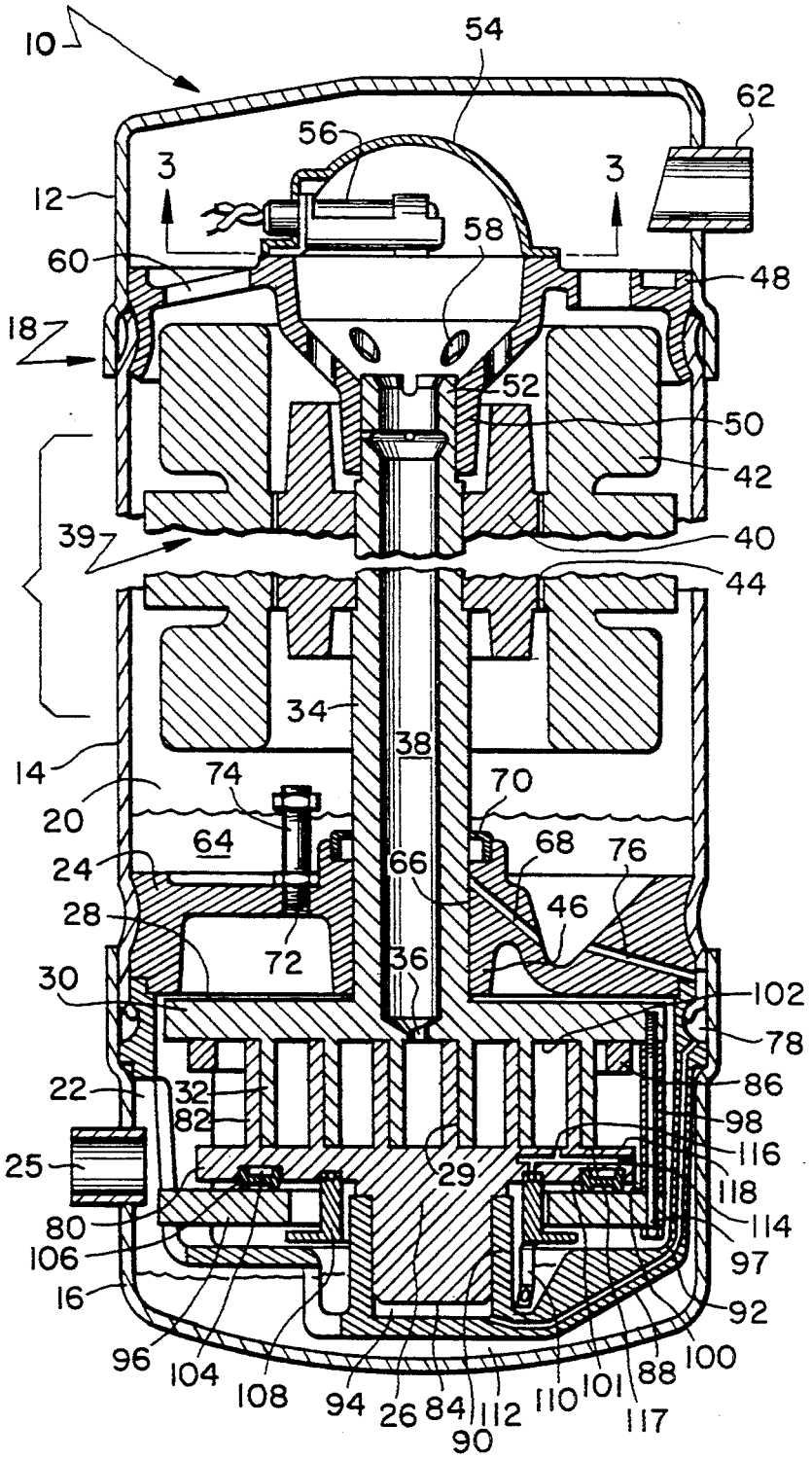
FIG. 1 is a cross-sectional view of the compressor of the present invention.

Referring first to FIGS. 1 and 2, co-rotating scroll compressor 10 is comprised of an upper shell portion 12, a middle shell portion 14 and a lower shell portion 16 all of which are sealingly connected to form a hermetic shell 18. Shell 18 is divided into a discharge pressure portion 20 and a suction pressure portion 22 by a central frame 24. Suction gas is communicated into suction pressure portion of shell 18 through suction fitting 25.

Disposed in suction pressure portion 22 of compressor 10 is an idler scroll member 26 and a drive scroll member 28. The drive and idler scroll members comprise the compression mechanism 29 of co-rotating scroll compressor 10. Drive scroll member 28 is comprised of an end plate 30 from which an involute wrap 32 extends in a first direction and from which a drive shaft 34 extends in the opposite direction. End plate 30 defines a discharge port 36 which is in flow communication with a discharge passage 38 defined in the drive shaft 34 of the drive scroll member.

Motor 39 has a rotor 40, which is penetrated by and fixedly attached to drive shaft 34 of the drive scroll member, and a stator 42 which is fixedly mounted in the discharge pressure portion 20 of compressor shell 18. A gap 44 is defined between rotor 40 and stator 42. Drive shaft 34 is rotatably carried in middle bearing housing 46 of central frame 24 within shell 18.

Upper frame 48 of compressor 10 includes an upper bearing housing 50 in which distal end 52 of drive shaft 34 is rotatably carried. Mounted on upper frame 48 is an oil separator dome 54 which is penetrated by an internal overload device 56. Alternatively, the overload device may be disposed in close proximity to or in contact with stator 42 as is illustrated in phantom at **56*a* in FIG. 2. Upper frame 48 defines a first series of apertures 58 through which discharge gas issuing from passage 38 of drive shaft 34 passes as well as a second set of apertures 60 through which discharge gas passes prior to exiting upper shell portion 12 of the compressor through discharge fitting 62**.

Defined in discharge pressure portion 20 of compressor 10 immediately above central frame 24 is a discharge pressure oil sump 64. Oil from sump 64 is provided to bearing surface 66 of middle bearing housing 46 through oil passage 68. A shaft seal 70 may be mounted in middle bearing housing 46 so as to sealingly surround drive shaft 34.

Middle bearing housing 46 also defines a passage 72 which opens into suction pressure portion 22 of compressor 10. Passage 72 is preferably at least partially threaded and an internal pressure relief valve 74 is threaded thereinto. Also defined by central frame 24 is an oil passage 76 which communicates with a circumferential oil passage 78. Passage 78 is preferably at least partially defined by shell 18.

Idler scroll member 26 has an end plate 80 from which involute wrap 82 extends in a first direction and from which a stub shaft 84 extends in the opposite direction. Involute wrap 82 of idler scroll member 26 is in interleaved engagement with involute wrap 32 of drive scroll member 28 which defines a discharge pocket 85 in flow communication with discharge port 36. An Oldham coupling 86 maintains the relative angular orientation of the wraps of the scroll members in operation and drivingly couples the drive to the idler scroll member.

Lower frame 88 is disposed in suction pressure portion 22 of shell 18 and includes an integral bearing housing 90 in which stub shaft 84 of the idler scroll member is rotatably accommodated. Lower frame 88 preferably defines an oil passage 92 which is in flow communication with circumferential oil passage 78 as well a space 94 defined by stub shaft 84 and lower bearing housing 90. The bearing surface of lower bearing housing 90 in which idler stub shaft 84 rotates is provided with lubricant driven from discharge pressure sump 64 through passages 76, 78 and 92 and through space 94 by the discharge pressure to which sump 64 is exposed when compressor 10 is in operation and by the differential pressure across the bearing.

Attached to drive scroll member 28 for rotation therewith is a pressure plate 96. Pressure plate 96 can be a unitary member having a plurality of legs which extend upwardly therefrom for attachment to drive scroll end plate 30. Such a unitary member is illustrated in co-pending U.S. patent application Ser. No. 08/125,684 which is assigned to the assignee of the present invention.

Alternatively, as is illustrated in FIGS. 1 and 1*a* and as is more specifically set forth in a patent application assigned to the assignee and filed of even date herewith, pressure plate 96 may be attached to drive scroll end plate 30 by a plurality of fasteners 97 and spacers 98. Spacers 98 define the distance between the surface 100 of pressure plate 96 which is juxtaposed the undersurface 101 of idler scroll member end plate 80 and the surface 102 of the drive scroll member from which the drive scroll involute wrap extends.

Idler scroll end plate 80 defines an annular groove 104 in its undersurface 101 in which a seal 106 is disposed. Seal 106 is in sliding contact with surface 100 of pressure plate 96. In operation, a fluid available from within the compressor at a pressure greater than compressor suction pressure, such as the gas undergoing compression between the scroll wraps or lubricant from discharge pressure sump 64 or elsewhere, is communicated through a passage (not shown) in idler scroll member that opens into groove 104. As a result, seal 106 is pressure biased toward pressure plate surface 100 and the idler scroll member is, in turn, axially pressure biased toward the drive scroll member.

Also carried by idler scroll member 26 is an annular lubricant pickup member 108 which includes a depending portion 110 having a distal end disposed in suction pressure lubricant sump 112 in suction pressure portion 22 of the compressor shell. Pickup member 108 defines a passage which is in flow communication with a lubricant passage 114 defined in idler scroll member 26 and lubricant sump 112.

The rotation of lubricant pickup member 108 within sump 112 causes lubricant to flow from sump 112 through pickup member 108 and into lubricant passage 114 in the idler scroll member. A portion of such lubricant is directed through a branch passage 116 of passage 114 to an opening in the surface 118 of idler scroll member 26 from which idler scroll wrap 82 extends. The lubricant directed through branch passage 116 lubricates the interface between the tip 117 of drive scroll involute 32 and surface 118 of the idler scroll member.

Figure 5:
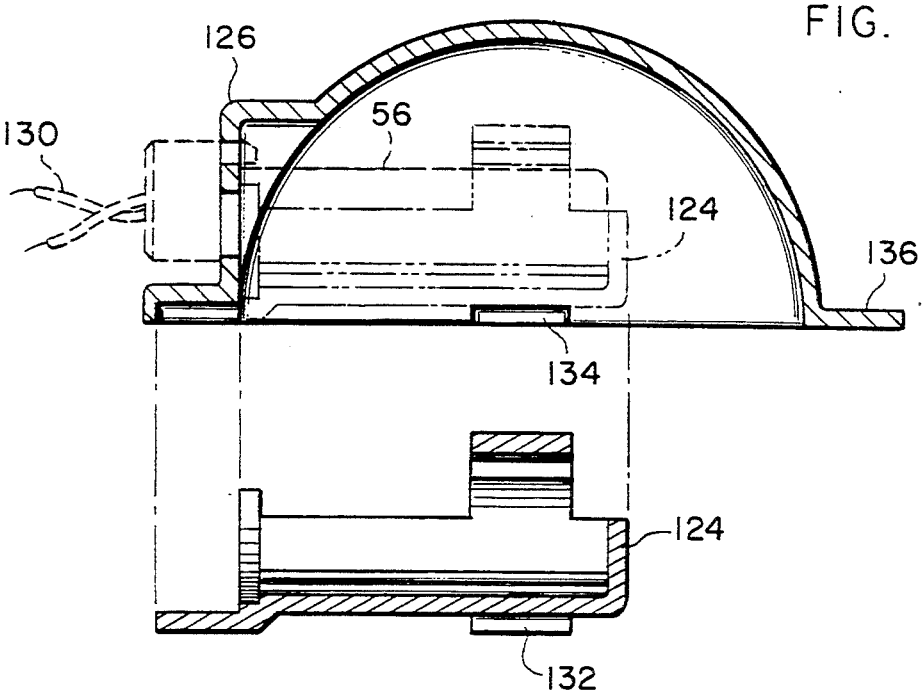
FIG. 5 is a cross-sectional view of the oil separator dome taken along line 5—5 of FIG. 4.
Figure 4:
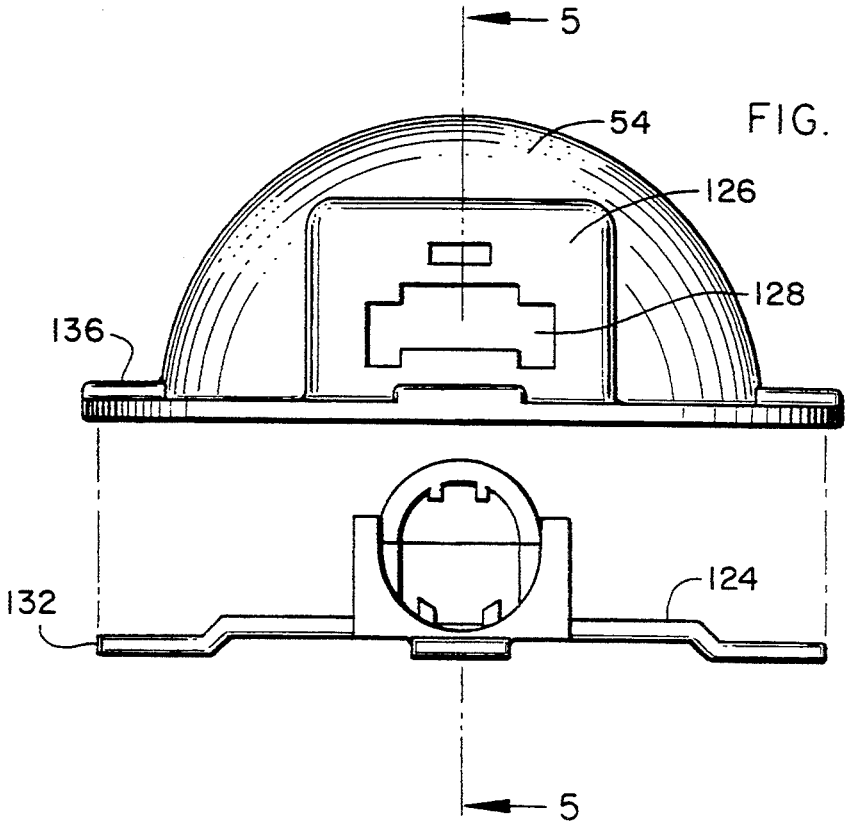
FIG. 4 is a side view of the dome of FIG. 3.

Referring additionally now to Drawing FIGS. 3, 4 and 5, the oil separation and management arrangement of the present invention will be more thoroughly described. Oil separator dome 54 is fixedly attached to upper frame 48 of compressor 10 as by screws 120 which penetrate apertures 122 in dome 54. It will be appreciated that dome 54 could otherwise be secured to upper frame 48 such as by the use of some form of bonding, adhesive or by its engagement with a clip-like arrangement formed into or attached to the upper frame. Dome 54 is penetrated by overload device 56 which is nested in a holder 124 that is configured to accommodate overload 56 and retain it securely in place.

Dome 54 includes a portion 126 which defines an aperture 128 through which overload device 56 and/or its electrical leads 130 extend. Extensions 132 of holder 124 are accommodated in slots 134 defined in the periphery 136 of dome 54 such that when the dome is secured to the upper bearing housing, holder 124 is secured internal of the dome with overload device 56 being ensconced therein. It will be appreciated that dome 54 and/or holder 124 will preferably be fabricated from plastic or another engineered material although their fabrication from sheet metal or by another metal stamping or forming process can likewise be accomplished. If fabricated from sheet metal, overload device 56, which is electrically "hot" would have to be electrically isolated therefrom.

In operation, energization of motor 39 causes rotor 40 and therefore drive shaft 34 and drive scroll member 28 to rotate. The rotational motion of drive scroll member 28 is transferred through Oldham coupling 86 to idler scroll member 26 such that the drive and idler scroll members move in relative orbital motion with respect to each other. The rotation of drive scroll member 28 likewise causes the rotation of pressure plate 96 which is fixedly attached to it.

The rotation of the drive and idler scroll members together with the development of discharge pressure in the discharge pressure portion 20 of the compressor shell causes lubricant in discharge pressure oil sump 64 and suction pressure oil sump 112 to be delivered to various bearing surfaces and locations within the compressor as has been described. As suction gas enters suction fitting 25, surrounds the periphery of the compression mechanism 29 and is drawn thereinto, oil in the suction pressure portion of shell 18 becomes entrained in the gas. As was also mentioned above, oil may be directed into the compression pockets, such as through passage 116, for cooling and lubrication purposes. Therefore, the refrigerant gas compressed in the pockets defined by the drive and idler scroll members carries with it a quantity of entrained oil as it is carried out of discharge port 36 into discharge passage 38 defined by scroll member drive shaft 34.

It will be appreciated that if the oil carried out of drive shaft 38 were not disentrained from the gas passing out of the compressor 18 through discharge fitting 62, the compressor and its bearing surfaces would eventually become starved for oil resulting in its catastrophic damage or failure. Therefore, the disentrainment of oil from the compressed discharge gas is a prerequisite to the operation of compressor 10.

The rotation of drive scroll member 28 and its drive shaft 34, together with the continuous discharge of compressed gas in which lubricant is entrained into discharge passage 38 of the drive shaft from compression mechanism 29, causes the mixture of compressed gas and entrained lubricant to move upwardly within drive shaft 34 along a swirling or cyclonic path as will the definition of discharge port 36 off of the centerline of drive shaft 34. The cyclonic motion of the mixture causes at least a portion of the lubricant entrained in the gas to be centrifugally urged radially outward to inner surface 138 of discharge passage 38.

Inner surface 138 of drive shaft 34 optionally includes a relieved portion 140 in its distal end 52. Relieved portion 140 communicates with upper bearing surface 142 of upper bearing housing 50 through one or more lubricant passages 144.

Disentrained lubricant urged radially outward within discharge passage 38 onto inner surface 138 vertically below relieved portion 140 will migrate upwardly and into the relieved portion. In addition, a further portion of the lubricant entrained in the discharge gas will be disentrained and urged radially outward directly into relieved portion 140 in the immediate vicinity of relieved portion 140. Lubricant making its way into relieved portion 140 will be centrifugally urged outward by the rotation of drive shaft 34 through passages 144 and will be delivered to upper bearing surface 142 for the lubrication thereof.

Additional lubricant will make its way past relieved portion 140 of drive shaft 34 in the discharge gas stream and will be carried thereoutof into the space 145. Space 145 is defined immediately above distal end 52 of the drive shaft by funnel shaped portion 146 of upper frame 48 and by dome 54. With respect to upper bearing surface 142, that surface will preferably be a self-lubricating bearing insert or an integral surface of upper bearing housing 50.

As the mixture of refrigerant gas and any lubricant which continues to be entrained therein exits distal end 52 of drive shaft 34, it impacts inner surface 148 of dome 54. Impact of the gas and entrained lubricant on interior surface 148 of dome 54 causes the disentrainment of the lubricant. The disentrained lubricant adheres to and flows radially outwardly and downwardly along interior surface 148 of dome 54 and onto the inner wall 150 of funnel shaped portion 146 of upper frame 48. The lubricant flows down surface 150 into a reservoir 152 immediately above upper bearing housing 50 from where it is fed to upper bearing surface 142 for lubrication purposes. Refrigerant gas from which oil has been disentrained makes its way out of apertures 58 in funnel portion 146 of upper frame 48 thence through passages 60 in upper frame 48 and out of discharge fitting 62.

It will be appreciated that by the disposition of overload device 56, which is a component by which compressor 10 is protected against damage due to the occurrence of abnormal operating conditions, within dome 54, the overload device will be exposed to discharge gas as closely proximate the point at which it is discharged from compression mechanism 29 as is possible. It is therefor a location where the temperature of the discharge gas will very closely approximate the temperature of the gas as it is discharged from discharge port 36 in the drive scroll member.

Among the abnormal operating conditions which can occur and the existence of which must be sensed quickly in order to prevent damage to the compressor is the existence of discharge gas temperatures which exceed a predetermined allowable maximum discharge temperature. The development of excessively high discharge temperatures in a compressor are indicative of a condition within the compressor or within the refrigeration system in which it is employed suggestive of the fact that the compressor and/or refrigeration system may fail unless the compressor is de-energized quickly.

Because such a condition can develop very rapidly as can the damage resulting therefrom, it is advantageous for the overload sensor to be disposed as close as possible to the discharge gas at is exits the compression mechanism in a scroll compressor where refrigerant gas temperatures will be their highest. The arrangement of the present invention, wherein the overload device 56 is ensconced in a holder which is directly exposed to discharge gas as it exits the compression mechanism, is therefore highly advantageous. Such disposition of the device is accomplished both inexpensively and integrally as it is coincident with the disposition and use of the apparatus by which lubricant is disentrained from the refrigerant gas as it is discharged from the compression mechanism.

Figure 6:
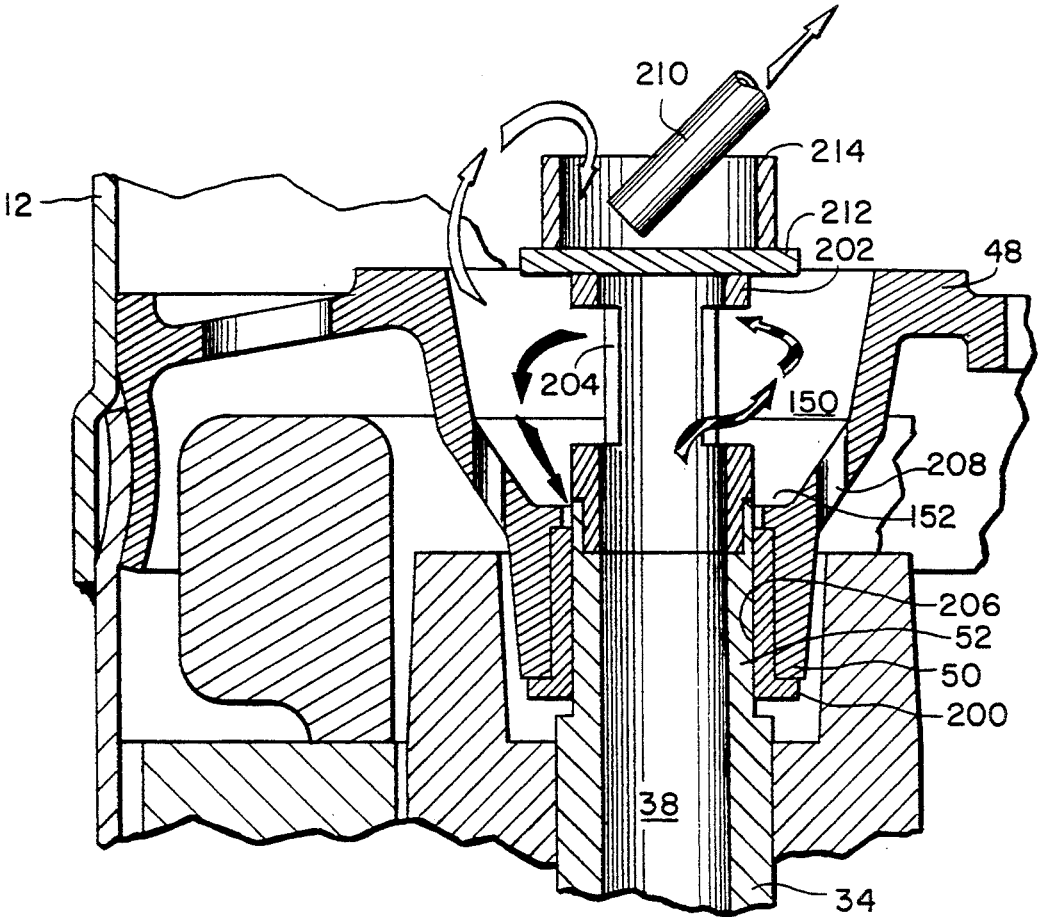
FIG. 6 is an alternative embodiment of the oil separation/lubrication arrangement of the present invention.

Referring now to FIG. 6, an alternative embodiment of the present invention is disclosed. In the embodiment of FIG. 6, a separate self-lubricating bearing insert 200 is ensconced in upper bearing housing 50. A baffle 202, which may be integral with distal end 52 of drive shaft 34 or a separate fitting attached thereto, defines relatively large apertures 204 through which discharge gas and any oil entrained therein must pass in order to exit the vicinity of the distal end of the drive shaft.

The spinning motion of baffle 202 and the radially outward facing of apertures 204 causes the refrigerant gas discharge from shaft 34 and any entrained lubricant to be urged centrifugally outward so as to impinge on surface 150 of funnel shaped portion 146 of upper frame 48. Like the embodiment of FIGS. 1–5, disentrained oil drains downwardly on surface 150 and is fed therefrom to the surface 206 of upper bearing 200 which requires lubrication.

It will be appreciated that in the embodiment of FIG. 6, relieved portion 140 of drive shaft 34 has been dispensed with so that lubrication of upper bearing 200 relies entirely upon the disentrainment of oil from the gas discharged through apertures 204 of baffle 202 and the delivery of that oil to reservoir 152 for upper bearing lubrication purposes. It is also to be noted that any excess disentrained oil will overflow out of funnel shaped portion 146 of upper frame 48 through apertures 208.

In the embodiment of FIG. 6, refrigerant gas from which oil has been disentrained and which has been imparted a spinning motion by the rotation of baffle 202 exits shaft 34 through apertures 204 and is delivered into upper shell 12 relatively free of entrained lubricant. A discharge tube 210 which is connected for flow to a discharge fitting similar to the one illustrated in FIGS. 1 and 2, opens immediately above plate portion 212 of baffle 202. Because lubricant exiting apertures 204 is urged radially outward and because the open end of discharge tube 210 is disposed immediately above but is shielded from the terminal end of drive shaft 34 by plate 212 and upstanding wall portion 214 of baffle 202, the refrigerant gas entering discharge tube 210 will be the relatively most lubricant-free refrigerant gas available from within the confines of the shell 18 of compressor 10.

While the present invention has been described in terms of a preferred and alternative embodiment, it will be appreciated that other modifications thereto will be apparent to those skilled in the art from the teachings provided hereby. Therefore, the present invention is not limited to the embodiments described and illustrated but includes other embodiments also which are their equivalent and which fall within the scope of the language of the claims which follow.

What is claimed is:

1. What is claimed is a scroll compressor comprising:

a shell, said shell defining a discharge pressure portion and a suction pressure portion;

a first scroll member rotatably disposed in said shell;

a second scroll member rotatably disposed in said shell, said first and said second scroll members constituting a gas compression mechanism and cooperating to define a discharge pocket, one of said first and said second scroll members having a shaft extending therefrom, said shaft having a distal end and defining a passage in flow communication with said discharge pocket and said discharge pressure portion of said shell, substantially all of the gas compressed in said compression mechanism and any lubricant entrained therein being constrained to flow through said passage to said distal end of said shaft;

a motor disposed in said discharge pressure portion of said shell, said motor being drivingly coupled to said shaft;

bearing means accommodating the rotation of said distal end of said shaft; and means for lubricating said bearing means with lubricant carried by compressed gas out of said discharge pocket of said compression mechanism into said passage in said shaft of said second scroll member, substantially all of the lubricant carried out of said compression mechanism being disentrained from said gas at said distal end of said shaft and in the proximity of said bearing means.

2. The compressor according to claim 1 wherein said means for lubricating said bearing means includes means for disentraining lubricant from said gas.

3. The compressor according to claim 2 wherein said distal end of said shaft of said second scroll member extends through said motor into said bearing means.

4. The compressor according to claim 3 wherein said means for lubricating said bearing means includes means for disentraining lubricant from said compressed gas internal of said passage defined by said shaft, at least a portion of the lubricant so disentrained being directed through said drive shaft to said bearing means.

5. The compressor according to claim 3 wherein said means for disentraining includes lubricant separation means overlying said distal end of said shaft.

6. The compressor according to claim 5 further comprising a frame in which said bearing means is disposed, said lubricant separation means and said frame cooperating to define a lubricant disentrainment area in said discharge pressure portion of said shell through which gas discharged from said discharge pocket flows prior to exiting said shell, lubricant disentrained from said gas in said disentrainment area being directed to said bearing means for the lubrication thereof.

7. The compressor according to claim 6 wherein said lubricant separation means is a solid member, lubricant entrained in said gas impinging upon said solid member after issuing from said distal end of said shaft, the impingement of said lubricant on said solid member causing said lubricant to be disentrained from said gas.

8. The compressor according to claim 7 wherein said solid member is dome-like and wherein lubricant disentrained from said gas in said disentrainment area is directed by a surface of said frame to said bearing means, said surface of said frame defining at least one aperture through which gas from which lubricant has been disentrained exits said disentrainment area.

9. The compressor according to claim 5 further comprising means for sensing the temperature of gas discharged from said discharge pocket.

10. The compressor according to claim 6 further comprising means for sensing the temperature of gas discharged from said discharge pocket, said means for sensing being disposed in said disentrainment area.

11. The compressor according to claim 10 wherein said lubricant separation means is a dome-like member and is fabricated from a non-metallic material.

12. The compressor according to claim 11 wherein said means for sensing comprises a sensor and a sensor holder, said sensor being disposed in said sensor holder and said sensor holder being disposed in said disentrainment area.

13. The compressor according to claim 6 wherein said shaft defines a relieved portion in said passage, said relieved portion being in flow communication with said bearing means, a portion of the lubricant carried out of said discharge pocket in said gas being disentrained from said gas internal of said passage and being communicated into said relieved portion and to said bearing means by the centrifugal force imposed on said lubricant by the rotation of said shaft.

14. The compressor according to claim 6 wherein said frame defines a lubricant reservoir, said reservoir collecting lubricant disentrained from said gas in said disentrainment area and being in flow communication with said bearing means.

15. The compressor according to claim 6 wherein said bearing means comprises an integral surface of said frame.

16. The compressor according to claim 6 wherein said bearing means is a discrete bearing disposed in said frame.

17. The compressor according to claim 4 wherein said means for disentraining lubricant in said passage includes a relieved portion defined in said passage, said relieved portion being in flow communication with said bearing means through a passage defined through said shaft, and lubricant separation means overlying said distal end of said shaft, said lubricant separation means comprising a dome-like member upon which lubricant issuing from said distal end of said compressor in said gas impinges thereby causing the disentrainment of said lubricant from said gas.

18. The compressor according to claim 3 wherein said means for disentraining includes baffle means attached to said distal end of said shaft for rotation therewith.

19. The compressor according to claim 18 wherein said baffle means defines a radially outwardly facing aperture.

20. The compressor according to claim 19 wherein said baffle means includes a solid portion overlying said distal end of said shaft.

21. The compressor according to claim 20 wherein said compressor further comprises a discharge conduit, said conduit having an open end disposed above said solid portion of said baffle means.

22. The compressor according to claim 21 wherein said baffle means includes an upstanding wall portion extending from said solid portion, said open end of said discharge conduit being disposed internal of the area defined within said wall portion above said solid portion.

23. A scroll compressor comprising:

a shell, said shell defining a discharge pressure portion and a suction pressure portion;

a first scroll member disposed in said suction pressure portion of said shell;

a second scroll member disposed in said suction pressure portion of said shell, said second scroll member and said first scroll member cooperating to define a plurality of gas compression pockets including a discharge pocket, said second scroll member having a drive shaft extending therefrom the distal end of which is disposed in said discharge pressure portion of said shell, said drive shaft defining a passage in flow communication with said discharge pocket and said discharge pressure portion of said shell, substantially all of the gas discharged from said discharge pocket and any lubricant entrained therein being constrained to flow through said passage to the distal end of said drive shaft;

a drive motor disposed in said discharge pressure portion of said shell, said drive shaft of said second scroll member extending through said motor and being drivingly coupled thereto;

first bearing means disposed in said suction pressure portion of said shell, said first scroll member being rotatably accommodated in said first bearing means;

second bearing means, said drive shaft of said second scroll member extending through and being rotatably accommodated in second bearing means;

third bearing means, said distal end of said drive shaft of second scroll member being rotatably accommodated in said third bearing means; and means for lubricating said third bearing means with lubricant carried out of said discharge pocket in the gas discharged from said discharge pocket into said passage defined by said drive shaft of said second scroll member, the disentrainment of substantially all of said lubricant carried out of said discharge pocket occurring at the distal end of said drive shaft in the proximity of said third bearing means.

24. The compressor according to claim 23 wherein said means for lubricating said third bearing includes means for disentraining lubricant from the gas discharge from said discharge pocket.

25. The compressor according to claim 24 wherein said means for disentraining includes lubricant separation means juxtaposed said distal end of said shaft.

26. The compressor according to claim 25 further comprising a frame disposed in said discharge pressure portion of said shell, said third bearing means being disposed in said frame, said lubricant separation means and said frame cooperating to define a lubricant disentrainment area at said distal end of said drive shaft, lubricant disentrained from said gas in said disentrainment area being directed to said third bearing means for lubrication thereof.

27. The compressor according to claim 26 wherein said lubricant separation means is a dome-like member, the impingement of lubricant entrained in said gas on said dome-like member causing said lubricant to be disentrained from said gas.

28. The compressor according to claim 27 further comprising means for sensing the temperature of gas issuing from said distal end of said drive shaft, said means for sensing being disposed in said disentrainment area.

29. The compressor according to claim 28 further comprising a holder for said means for sensing temperature, said holder being disposed in said disentrainment area in said dome-like member, said holder and said dome-like member being fabricated from a non-metallic material.

30. The compressor according to claim 23 wherein said means for lubricating said third bearing means includes means for disentraining lubricant from said gas in said drive shaft passage and for directing said disentrained lubricant through said drive shaft to said third bearing means.

31. The compressor according to claim 30 wherein said means for disentraining and directing comprises a relieved portion of said drive shaft in flow communication with said drive shaft passage.

32. The compressor according to claim 23 wherein said means for lubricating said third bearing means comprises baffle means attached to said distal end of said drive shaft for rotation therewith, said baffle means defining a radially outward facing aperture and having a solid portion which overlies said distal end of said drive shaft so that gas issuing from said passage in said drive shaft is caused to change direction in order to exit said baffle means.

33. The compressor according to claim 32 wherein said change in direction in said gas and the impingement of said gas on said solid portion of said baffle means causes the disentrainment of lubricant entrained in said gas, the disentrained lubricant being directed to said third bearing means.

34. A method of lubricating a bearing in a gas compressor of the co-rotating scroll type where the compressor has a discharge pressure portion in which a motor is disposed, a suction pressure portion in which a compression mechanism is disposed and a motor-driven drive shaft which defines a passage between the compression mechanism and the discharge pressure portion of the compressor, the bearing being rotatably accommodating the distal end of the drive shaft, comprising the steps of:

entraining lubricant in the gas undergoing compression in the compression mechanism;

communicating all of the compressed gas in which lubricant is entrained out of the compression mechanism into and through the passage in the drive shaft to the distal end thereof;

disentraining substantially all of the lubricant from the compressed gas in the proximity of said distal end of said drive shaft; and directing at least a portion of the disentrained lubricant to the bearing at the distal end of said drive shaft.

35. The method according to claim 34 further comprising the step of juxtaposing a disentrainment surface in the flow path of gas issuing from the passage in the drive shaft.

36. The method according to claim 35 further comprising the step of defining a lubricant disentrainment area in said compressor, said disentrainment surface cooperating in the definition of said disentrainment area.

37. The method according to claim 36 further comprising the step of sensing the temperature of said gas as it issues from the distal end of said drive shaft.

38. The method according to claim 37 further comprising the step of de-energizing the compressor when the temperature sensed in said sensing step exceeds a predetermined temperature.

39. The method according to claim 36 wherein said disentraining step includes the step of disentraining lubricant from the compressed gas internal of said passage and wherein said directing step includes the step of directing lubricant disentrained in said passage through said drive shaft to said bearing.

* * * * *